US008684760B1

(12) United States Patent
Lam et al.

(10) Patent No.: US 8,684,760 B1
(45) Date of Patent: Apr. 1, 2014

(54) POWER CORD WITH ANTI-THEFT ASSEMBLY

(71) Applicant: Google Inc., Mountain View, CA (US)

(72) Inventors: Lawrence Lam, San Jose, CA (US); Amy Han, Palo Alto, CA (US)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 13/743,338

(22) Filed: Jan. 17, 2013

Related U.S. Application Data

(63) Continuation of application No. 13/553,526, filed on Jul. 19, 2012, now abandoned, which is a continuation of application No. 13/072,134, filed on Mar. 25, 2011, now abandoned.

(51) Int. Cl.
*H01R 13/62* (2006.01)

(52) U.S. Cl.
USPC ..... 439/352; 439/348; 439/354; 439/372; 439/133; 174/135; 24/129 B; 24/115 H

(58) Field of Classification Search
USPC ..... 439/348, 352, 353, 354, 372, 133; 174/135; 24/129 R, 129 B, 115 H
See application file for complete search history.

(56) References Cited

U.S. PATENT DOCUMENTS

| | | | | |
|---|---|---|---|---|
| 5,398,530 | A | 3/1995 | Derman | |
| 6,056,563 | A | 5/2000 | Betzler | |
| 6,159,025 | A | 12/2000 | Derman | |
| 6,636,432 | B2 | 10/2003 | Chao | |
| 6,739,896 | B2 | 5/2004 | Sivertsen | |
| 6,763,688 | B1 | 7/2004 | Syu | |
| 6,773,292 | B2 | 8/2004 | Fawcett | |
| 6,796,152 | B1 | 9/2004 | Yu | |
| 6,971,255 | B2 | 12/2005 | Bhogal et al. | |
| 6,981,888 | B2 | 1/2006 | O'Keefe et al. | |
| 7,075,011 | B1 | 7/2006 | Kogure et al. | |
| 7,331,813 | B2 | 2/2008 | Tsujita | |
| 7,384,295 | B2 | 6/2008 | Hankey et al. | |
| 8,214,913 | B2 | 7/2012 | Chung et al. | |
| 8,545,252 | B2 * | 10/2013 | Wang et al. | 439/352 |
| 2006/0003619 | A1 | 1/2006 | Hynds et al. | |
| 2007/0293066 | A1 | 12/2007 | Hynds et al. | |
| 2010/0124843 | A1 | 5/2010 | Yang et al. | |
| 2011/0128823 | A1 | 6/2011 | Lay | |

OTHER PUBLICATIONS

References from Web, Nov. 15, 2010, 1 page.
"Kensington Security Slot Specifications", Kensington Computer Products Group, 2006, 1 page.

* cited by examiner

*Primary Examiner* — Gary Paumen
(74) *Attorney, Agent, or Firm* — Brake Hughes Bellermann LLP

(57) ABSTRACT

Various example embodiments are disclosed. According to an example embodiment, a lockable power cord may include a power module, a locking member, a power cord, a power supply, and a loop. The locking member may include at least one arm member biased radially outward from the power module to an expanded state. The locking member may be configured to move radially inward toward the power module in response to the power module entering into the power receptacle, and expand radially away from the power module into a locking cavity of the power receptacle when the power module enters beyond a locking point within the power receptacle. The loop may include at least a first opening having a width smaller than a width of the power supply.

20 Claims, 15 Drawing Sheets

POWER CORD WITH ANTI-THEFT ASSEMBLY

PRIORITY CLAIM

This application is a continuation of U.S. patent application Ser. No. 13/553,526, entitled "POWER CORD WITH ANTI-THEFT ASSEMBLY" and filed on Jul. 19, 2012; which, in turn, is a continuation of U.S. patent application Ser. No. 13/072,134, entitled "POWER CORD WITH ANTI-THEFT ASSEMBLY" and filed on Mar. 25, 2011, the disclosures of which are hereby incorporated by reference.

TECHNICAL FIELD

This description relates to securing portable computing devices

BACKGROUND

Portable computing devices are valued due to their ease of use and portability. However, their portability can also make them objects of theft.

SUMMARY

According to one general aspect, a lockable power cord may include a power module, a locking member, a power cord, a power supply, and a loop. The power module may be configured to enter into a power receptacle of a computing device and to provide power to the computing device. The locking member may include at least one arm member biased radially outward from the power module to an expanded state. The locking member may be configured to move radially inward toward the power module in response to the power module entering into the power receptacle, and expand radially away from the power module into a locking cavity of the power receptacle when the power module enters beyond a locking point within the power receptacle. The power cord may be electrically coupled to the power module. The power supply may be integrally coupled to the power cord between the power module and the plug. The loop may be mechanically coupled to the power cord. The loop may include at least a first opening having a width smaller than a width of the power supply and have a shape configured to receive and encircle at least a portion of the power cord between the power module and the power supply, and prevent the power supply from passing through the first opening.

According to another general aspect, a lockable power cord may include a power module, a cavity, a plurality of balls, a locking mechanism, a power cord, and a loop. The power module may be configured to enter a power receptacle of a computing device and to provide power to the computing device. The cavity comprising a plurality of balls, the cavity including an opening on an outer surface of the power module which has a width which is less than a diameter of the balls. The plurality of balls may be located within the cavity. The locking mechanism may be configured to force the plurality of balls to extend beyond the outer surface of the power module through the opening and into at least one apertures of the power receptacle, thereby preventing the power module from exiting the power receptacle, from within the cavity when the locking mechanism is in a locked state, and allow the plurality of balls to retract into the cavity of the power module, thereby allowing the power module to exit the power receptacle, when the locking mechanism is in an unlocked state. The power cord may be electrically coupled to the power module. The loop may be coupled to the power cord, and may be configured to receive the power cord and thereby secure the lockable power cord to an object around which the power cord extends.

The details of one or more implementations are set forth in the accompanying drawings and the description below. Other features will be apparent from the description and drawings, and from the claims.

DETAILED DESCRIPTION

Figure 1:
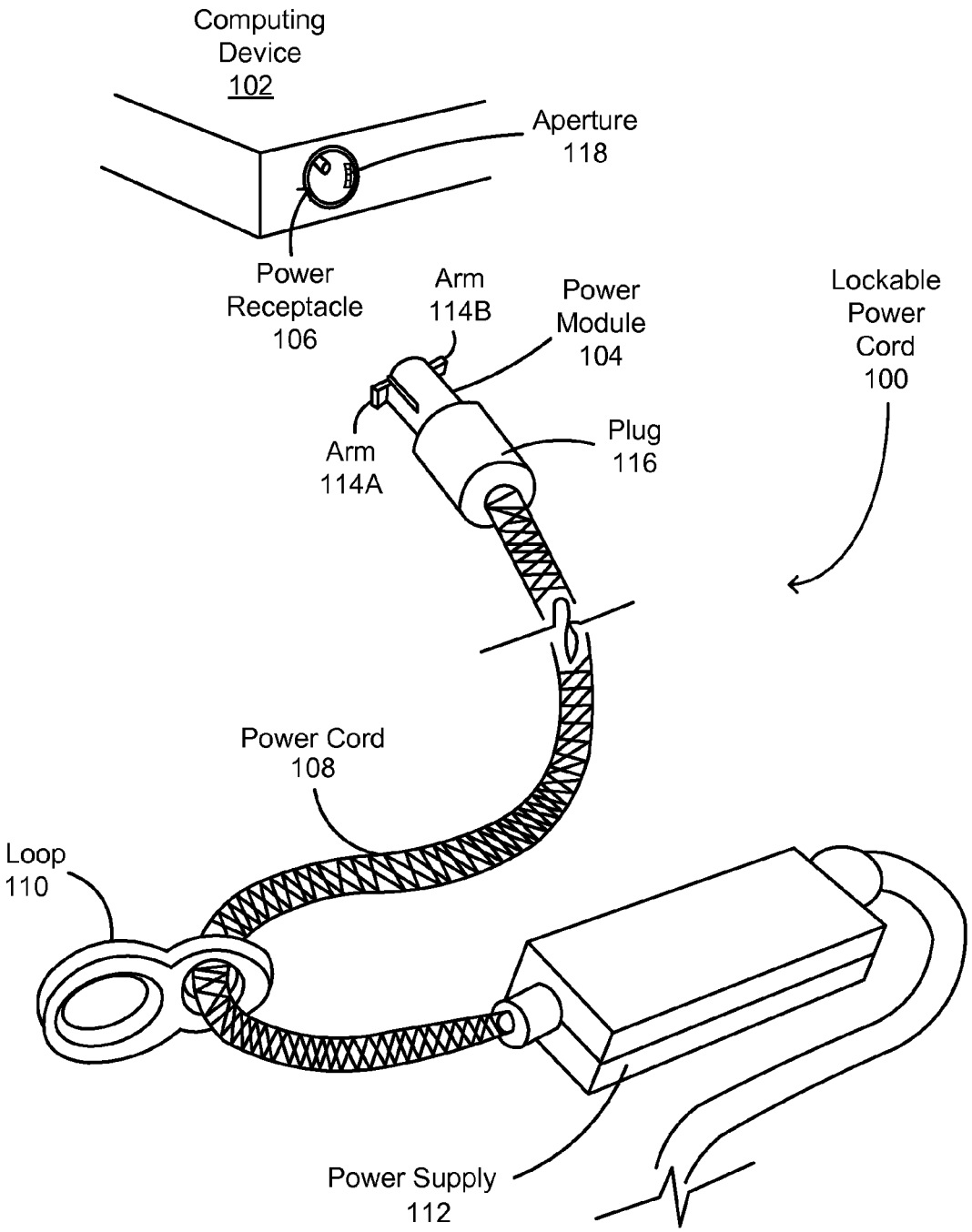
FIG. 1 is a diagram showing a lockable power cord and a portion of a computing device according to an example embodiment.

FIG. 1 is a diagram showing a lockable power cord 100 and a portion of a computing device 102 according to an example embodiment. The lockable power cord 100 may secured to the computing device 102 and to a fixed object, such as a table (not shown in FIG. 1), thereby securing the computing device 102 to the fixed object and preventing the computing device 102 from being stolen. The computing device 102 may, for example, include a laptop or notebook computer, or may include a desktop computer, server, tablet computer, or other computing device.

The lockable power cord 100 may also provide power to the computing device 102. The lockable power cord 100 may, for example, transmit power from a wall socket or power socket (not shown in FIG. 1) to the computing device 102.

The lockable power cord 100 may include a power module 104. The power module 104 may be a terminal portion of the power module 104 which provides power to the computing device 102. The power module 104 may include a conductive element or material, such as copper, aluminum, silver, gold, or other metal, which makes contact with a conductive portion of the computing device 102, thereby facilitating the transfer of power or electricity through the lockable power cord 100 to the computing device 102.

The power module 104 may have a generally cylindrical shape. The power module 104 may be inserted into, and received by, a power receptacle 106 of the computing device 102. The lockable power cord 100 may include a retention feature(s) or locking member coupled to the power module 104 to secure and/or lock the power module 104 into the power receptacle 106, described below.

The computing device 102 may include a power receptacle 106 which receives the power module 104. The power receptacle 106 may include a conductive element or material, such as copper, aluminum, silver, gold, or other metal, which makes contact with a conductive portion of the power module 104, thereby facilitating the transfer of power or electricity through the power module 104 of the lockable power cord 100 to the computing device 102. The power receptacle 106 may have a generally cylindrical shape of similar diameter to the power module 104, allowing the power receptacle 106 to receive the power module 104. The power receptacle 106 may also include a retention feature(s) corresponding to the retention feature(s) coupled to the power module 104, allowing the power module 104 to lock into the power receptacle 106, described below.

The lockable power cord 100 may also include a power cord 108. The power cord 108 may include an elongated and flexible cord. The power cord 108 may be flexible enough to wrap around objects, such as a table leg, to secure the lockable power cord 100 to the object.

The power cord 108 may include a conductive element or material, such as copper, aluminum, silver, gold, or other metal, to conduct electricity or power from a power source to the computing device 102 through the power module 104. The power cord 108 may also include an insulating material, such as rubber or plastic. The insulating material may surround the conductive material. The power cord 108 may also include an armored housing. The armored housing may surround the insulating material. The armored housing may prevent the power cord 108 from being cut, ripped, or torn. A cross-section of the power cord 108, including the conductive material, insulating material, and armored housing, is shown in, and described further with respect to, FIG. 6.

The lockable power cord 100 may also include a loop 110. The loop 110 may be coupled and/or secured to the power cord 108. The loop 110 may receive the power cord 108 and secure the power cord 108, as well as the lockable power cord 100 and the computing device 102 to which the lockable power cord 100 is locked, to a fixed object (not shown in FIG. 1), such as a desk, table, or chair. The loop 110 may include one or more apertures 111A, 111B, through which the power cord 108 may be threaded while wrapping the power cord 108 around the fixed object to secure the lockable power cord 108 to the fixed object. The loop 110 may be made of a resilient material, such as metal (including steel) or Kevlar, which is resistant to cutting or breaking, to prevent the lockable power cord 100 and computing device 102 from being moved without the owner first unlocking the lockable power cord 100 from the computing device 102. The loop 110 may serve as an anti-theft device, securing the lockable power cord 100 and computing device 102 to the fixed object.

The lockable power cord 100 may also include a power supply 112. The power supply 112 may convert and/or rectify alternating current (AC) power received from the wall socket into direct current (DC) power which is provided to the computing device 102. The power supply 112 may have a width along a shortest axis which is greater than a width along a longest axis of at least one of the apertures 111A, 111B of the loop. This greater width may prevent the lockable power cord 100 from passing through the respective aperture 111A, 111B, thereby securing the lockable power cord 100 to the loop 110.

Returning to the discussion of the power module 104, the retention feature(s) or locking member may include one or more arms 114A, 114B. The arms 114A, 114B may be biased to extend radially outward from the power module 104. While the term, "radially," is used herein to describe the arms 114A, 114B extending away from a longitudinal center line of the power module 104, this does not necessarily imply that the power module 104 must be circular or cylindrical; the power module 104 may be cylindrical, box-shaped, hexagonal, or otherwise shaped to enter the power receptacle 106 and provide power to the computing device 102, and include the arms 114A, 114B which are biased to extend radially outward from the power module 104. When the arms 114A, 114B extend radial outwardly, the locking member or retention feature may be considered to be in an "expanded state." The arms 114A, 114B may lock into the retention feature(s) of the power receptacle 106, locking the power module 104 into the power receptacle 106.

While the arms 114A, 114B may be biased radially outward from the power module 104 to the outward state, the arms 114A, 114B may move or fold radially inward toward the power module 104 to allow the power module 104 to enter the power receptacle 106 before the power module 104 is locked or secured inside the power receptacle 106. This process is described further with respect to FIGS. 3A, 3B, 3C, and 3D.

The lockable power cord 100 may also include a plug 116. The plug 116 may operate as a backstop to the power module 104, and prevent the power module 104 from being inserted into the power receptacle 106 beyond a point at which the plug 116 makes contact with the computing device 102. The plug 116 may also be a portion of the lockable power cord 100 held by a user plugging the power module 104 into the power receptacle 106. The plug 116 may surround a rear portion of the power module 104, and/or may surround a portion of the power cord 108 which meets the power module 104. The plug 116 may be cylindrical, and may have a diameter greater than the diameter of both the power module 104 and the power receptacle 106, in order to operate as the backstop to the power module 104. The plug 116 may be made of any solid material, such as plastic or rubber, and may be non-conductive, allowing a user to handle the plug 116 without being electrically coupled to the power module 104.

The retention feature of the power receptacle 106 may include one or more locking cavities or apertures 118. The locking cavities or apertures 118 may receive the arm(s) 114A, 114B and thereby lock or secure the power module 104 within the power receptacle 106. The locking cavities or apertures 118 may include apertures or slots along the cylinder or perimeter of the power receptacle 106. The locking cavities or apertures 118 may be located a distance from an opening of the power receptacle 106 which is equal to or less than a distance from the arms 114A, 114B to the plug 116, to allow the power module 104 to enter the power receptacle 106 deeply enough for the arms 114A, 114B to enter into or engage the aperture(s) 118, thereby securing or locking the power module 104 into the power receptacle 106.

Figure 2:
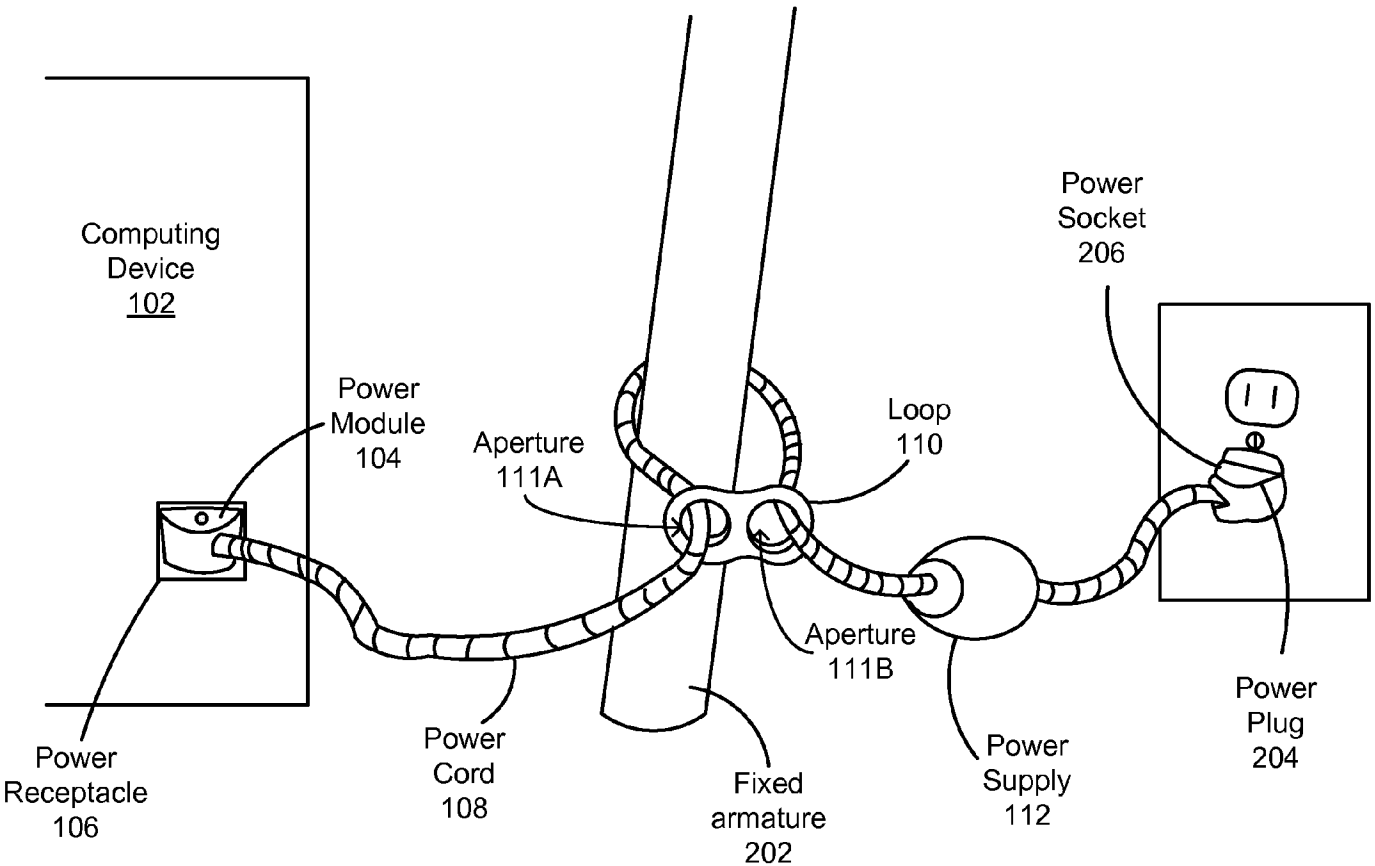
FIG. 2 is a diagram showing the lockable power cord locked to the computing device and secured to a fixed object according to an example embodiment.

FIG. 2 is a diagram showing the lockable power cord 100 locked to the computing device 102 and secured to a fixed object 202 according to an example embodiment. In this example, the power module 104 is secured or locked into the power receptacle 106 of the computing device 102, locking the computing device 102 to the lockable power cord 100.

Also in this example, the lockable power cord 100 is secured to the fixed object 202 using the loop 110. In this example, portions of the power cord 108 extend through each of two apertures 111A, 111B or openings of the loop 110. The fixed object 202 is thereby secured between a portion of the power cord 108 which is between the apertures 111A, 111B, and the loop 110. The greater width of the power supply 112 than the aperture 111B of the loop 110 may prevent the power supply 112 from passing through the aperture 111B of the loop 110, and the greater width of the computing device 104 than the aperture 111A of the loop 110 may thereby prevent the power cord 108 from sliding past the fixed object 202, securing the lockable power cord 100 to the fixed object 202. Either or both of the apertures 111A, 111B may be wider or narrower than the power module 104 and/or plug 116; the aperture(s) 111A, 111B may be wider than the power module 104 and/or plug 116 to facilitate easier transportation and storage of the lockable power cord 100, or the aperture(s) 111A, 111B may be narrower than the power module 104 and/or plug 116 to prevent the loop 110 from being lost, according to example embodiments. In an example embodiment, the loop 110 may include only one aperture.

FIG. 2 also shows a power plug 204 included in the lockable power cord 100. The power plug 204 may enter into, and receive power from, a power socket 206. The power socket 206 may include a wall socket, and may receive electricity or power from an external source, such as a power company. The power socket 206 may provide AC power to the lockable power cord 100, which the power supply 112 may convert into DC power. The power socket 206 may include slots which receive prongs of the power plug 204. Each of the slots and prongs may include conductive elements or materials, such as copper, aluminum, or other metal, to conduct the electricity or power from the external source to the computing device 102 through the lockable power cord 100, according to an example embodiment.

Figure 3A:
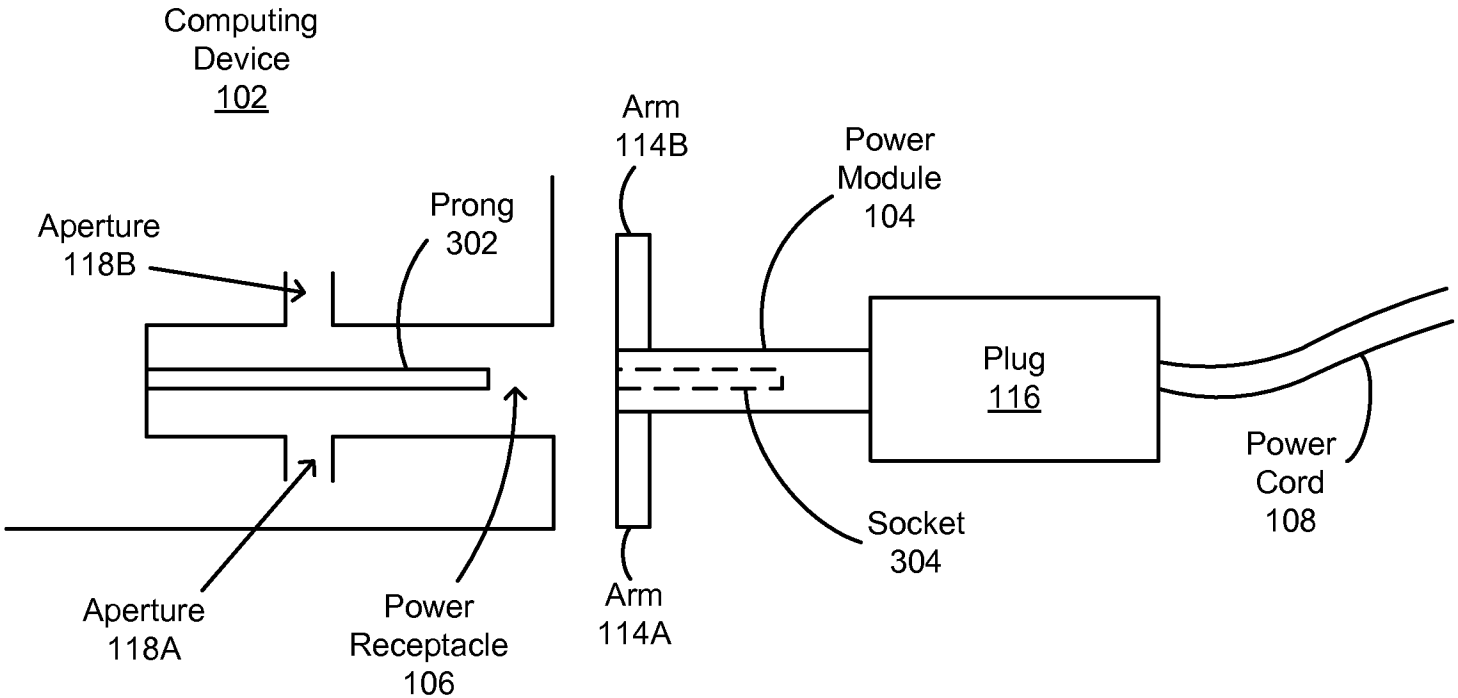
FIG. 3A is a diagram showing the lockable power cord and a power receptacle of the computing device according to an example embodiment in which the lockable power cord is capable of locking into the computing device by arms extending from a power module of the lockable power cord.

FIG. 3A is a diagram showing the lockable power cord 100 and the power receptacle 106 of the computing device 102 according to an example embodiment in which the lockable power cord 100 is capable of locking into the computing device 102 by arms 114A, 114B extending from the power module 104 of the lockable power cord 100. In this example, the arms 114A, 114B are extending away from the power module 104. The arms 114A, 114B may extend generally perpendicularly from the power module 104. The arms 114A, 114B may, for example, be coupled or connected to the power module 104 by a hinged and/or spring-loaded mechanism.

The hinged and/or spring-loaded mechanism may bias arms 114A, 114B to the position shown in FIG. 3A, i.e., generally perpendicular to the power module 104. The hinged and/or spring-loaded mechanism may allow the arms 114A, 114B to fold or move radially inward toward the power module 104 in response to pressure being applied to the arms in a direction toward the plug 116, such as when the power module 104 is inserted into, and/or enters, the power receptacle 106. The hinged and/or spring-loaded mechanism may, however, limit the range of motion of the arms 114A, 114B. The hinged and/or spring-loaded mechanism may limit the range of motion of the arms 114A, 114B to prevent the arms 114A, 114B from folding or extending away from the power module 104 beyond the perpendicular position shown in FIG. 3A. The hinged and/or spring-loaded mechanism may, for example, limit the range of motion of the arms 114A, 114B to no more than ninety degrees) (90°).

The retention feature(s) of the power receptacle 106 may include one, two, or more aperture(s) 118A, 118B corresponding to the arm(s) 114A, 114B of the power module 104. When the power module 104 has been inserted into the power receptacle 106, and/or when the power receptacle 106 receives the power module 104, the aperture(s) 118A, 118B may receive the arm(s) 114A, 114B, thereby securing or locking the power module 104 into the power receptacle 106. The apertures 118A, 118B may include apertures or recesses in the power receptacle 106. The apertures 118A, 118B may each have a width which is greater than the width of the corresponding arms 114A, 114B, enabling the arms 114A, 114B to fit into the apertures 118A, 118B, while still allowing some "play" or movement for the arms 114A, 114B within the apertures 118A, 118B, facilitating entry and exit of the arms 114A, 114B into and out of the apertures 118A, 118B.

The receptacle 106 may include a prong 302. The prong 302 may extend longitudinally through a center of the power receptacle 106. The prong 302 may secure, and/or engage in electrical contact with, the power module 104. The prong 302 may, for example, enter into, and be received by, a socket 304 of the power module 104. The socket 304 may be a cylindrical recess extending along a longitudinal axis through a center of the power module 104. The prong 302 and socket 304 may have similar diameters, enabling the prong 302 to snugly fit into the socket 304. In an example in which the power module 104 and power receptacle 106 make electrical contact via the socket 304 and prong 302, the socket 304 and prong 302 may each be made of conductive material(s) such as metal(s), including copper, aluminum, silver, or gold, as non-limiting examples.

Figure 3B:
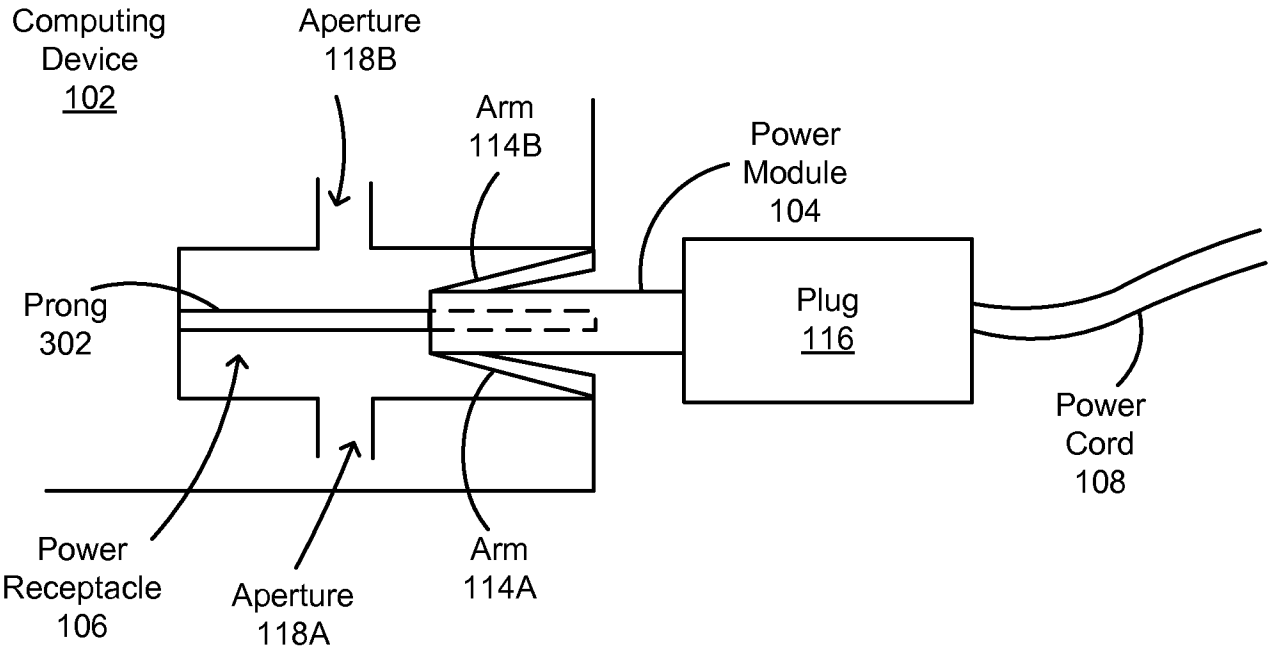
FIG. 3B is another diagram showing the lockable power cord and the power receptacle of the computing device according to the example embodiment shown in FIG. 3A.

FIG. 3B is another diagram showing the lockable power cord 100 and the power receptacle 106 of the computing device 102 according to the example embodiment shown in FIG. 3A. In this example, the power module 104 has been partially inserted into the power receptacle 106. The extension of the arms 114A, 114B beyond the power module 104 is wider than the width of the power receptacle 106. Because the arms 114A, 114B are wider than the power receptacle 106, the power module 104 may not fit into the power receptacle 106 with the arms 114A, 114B in their expanded state, in which the arms 114A, 114B extend radially outward from the power module 104.

Inserting the power module 104 into the power receptacle 106 applies pressure from the opening of the power receptacle 106 onto the arms 114A, 114B. This pressure forces the arms 114A, 114B to move or fold radially inward, away from the perimeter of the power receptacle 106 and toward the power module 104 into the position shown in FIG. 3B. In this folded or inward position, the arms 114A, 114B allow the power module 104 to enter the power receptacle 106.

While the power module 104 is entering the power receptacle 106, the prong 302 may enter the socket 304. Then entry of the prong 302 into the socket 304 may guide the power module 104 within the power receptacle 106, and/or the interface or contact between the prong 302 and socket 304 may serve as the conduit for electricity or power from the lockable power cord 100 into the computing device 102.

Figure 3C:
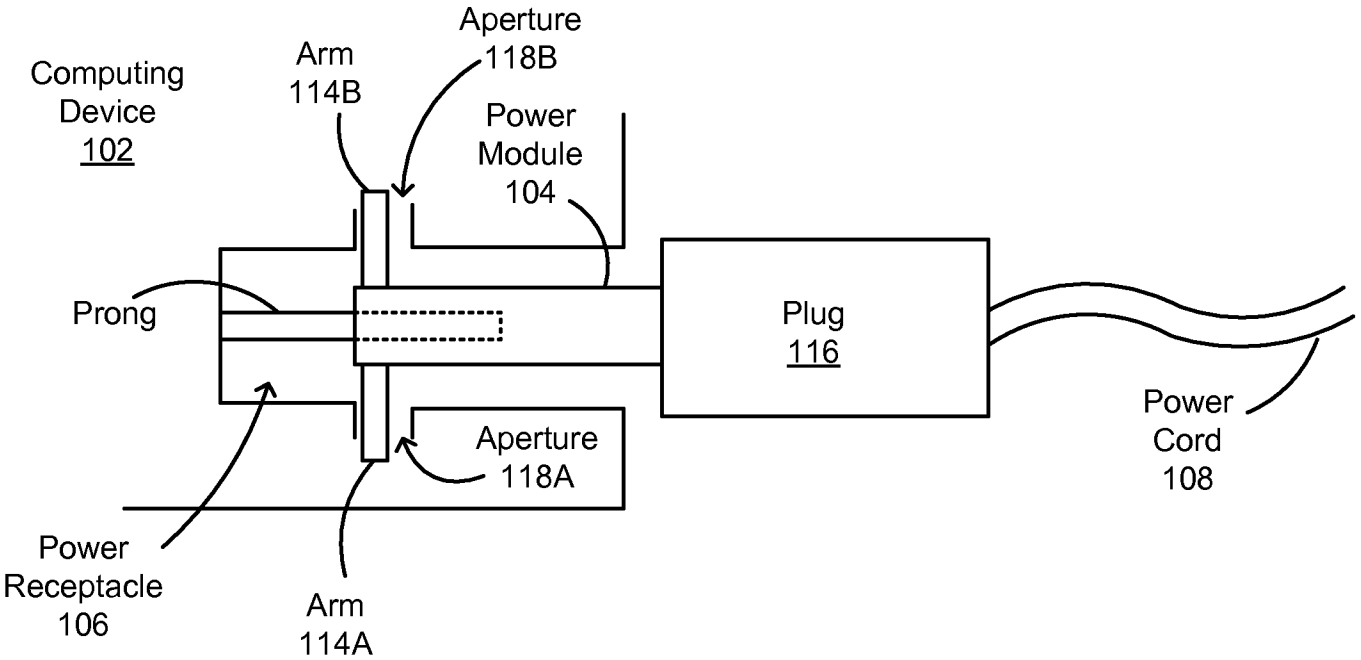
FIG. 3C is another diagram showing the lockable power cord and the power receptacle of the computing device according to the example embodiment shown in FIGS. 3A and 3B.

FIG. 3C is another diagram showing the lockable power cord 100 and the power receptacle 106 of the computing device 102 according to the example embodiment shown in FIGS. 3A and 3B. In this example, the power module 104 has passed a locking point within the power receptacle 106. The locking point within the power receptacle 106 may be a point at which the ends of the arms 114A, 114B reach the apertures 118A, 118B. When the ends of the arms 114A, 114B reach the apertures 118A, 118B, the arms 114A, 114B may extend into the apertures 118A, 118B. The extension of the arms 114A, 114B into the apertures 118A, 118B may relieve the pressure on the arms 114A, 114B from the perimeter of the power receptacle 106, allowing the arms 114A, 114B to expand radially from the power module 104 into the apertures 118A, 118B, until the arms 114A, 114B reach their expanded state extending perpendicularly into the apertures 118A, 118B. In this expanded state, the arms 114A, 114B and power module 104 may be locked and/or secured within the power receptacle 106 of the computing device 102.

The lockable power cord 100 and/or power module 104 may include a lock controller. The lock controller may control the locking mechanism of the arms 114A, 114B by locking the arms 114A, 114B into the expanded position, perpendicular to the power module 104, and/or preventing the arms 114A, 114B from moving or folding back inward toward the power module 104. By locking the arms 114A, 114B into the expanded position, the lock controller may prevent the power module 104 from being removed from the power receptacle 106, thereby locking or securing the lockable power cord 100 to the computing device 102. The lock controller may transition the locking mechanism, which may include the arm(s) 114A, 114B, from a locked state, in which the arms 114A, 114B are not allowed to fold or move inward toward the power module 104 from the expanded state, to an unlocked state, in which the arms 114A, 114B are allowed to fold or move inward toward the power module 104 from the expanded state, and vice versa. Example interfaces for the lock controllers are discussed further with respect to FIGS. 5A, 5B, 5C, and 5D.

Figure 3D:
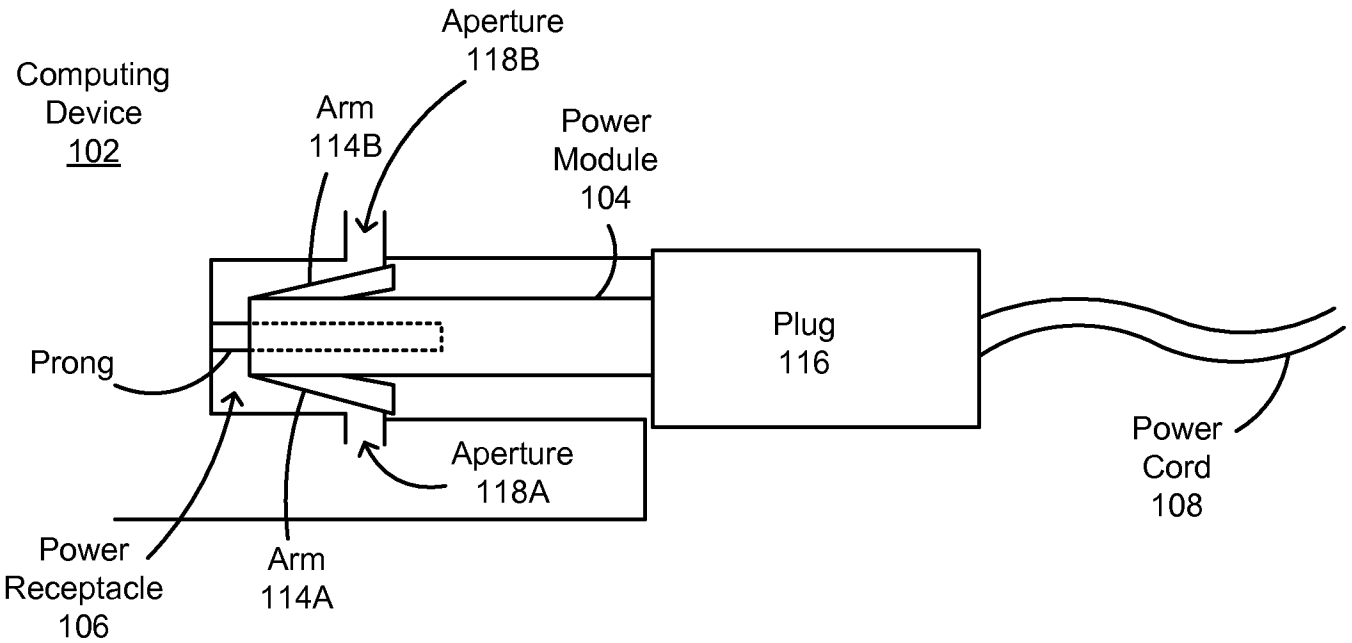
FIG. 3D is another diagram showing the lockable power cord and the power receptacle of the computing device according to the example embodiment shown in FIGS. 3A, 3B, and 3C.

FIG. 3D is another diagram showing the lockable power cord 100 and the power receptacle 106 of the computing device 102 according to the example embodiment shown in FIGS. 3A, 3B, and 3C. In this example, the power module 104 was previously locked into the power receptacle 106 with the arms 114A, 114B extending into the apertures 118A, 118B, as shown in FIG. 3C. In this example, the lock controller has been transitioned into the unlocked state, allowing the arms 114A, 114B to fold or move radially inward toward the power module 104. The power receptacle 106 may have sufficient depth to allow the power module 104 to move further into the power receptacle 106, causing the arms 114A, 114B to fold or move back toward the power module 104 until the arms 114A, 114B are no longer inside the apertures 118A, 118B. With the arms 114A, 114B no longer inside the apertures 118A, 118B, the power module 104 may be removed from the power receptacle 106. A user may twist the power module 104 within the power receptacle 106 to prevent the arms 114A, 114B from re-entering the apertures 118A, 118B upon removal of the power module 104 from the power receptacle 106, according to an example embodiment.

In an example embodiment, the apertures 118A, 118B may not extend all the way around the power receptacle 106, or through a 360° sweep of the power receptacle. Portions of the power receptacle 106 which have a same depth as the apertures 118A, 118B may not include apertures, and may include solid walls which prevent the arms 114A, 114B from extending into the computing device 102 beyond the power receptacle 106. A user may, for example, rotate the power module 104 to align the arms 114A, 114B with the portion(s) of the power receptacle 106 which does not include apertures and includes solid walls, the solid walls preventing the arms 114A, 114B from extending beyond their folded state, allowing the user to withdraw the power module 104 from the power receptacle 106.

In an example embodiment, the locking mechanism may prevent the power module 104 from rotating out of the locked position. For example, the computing device 102 and/or power module 104 may include bolts which, when the power module 104 is in the locked position with the arms 114A, 114B extending into the apertures 118A, 118B, prevent the arms 114A, 114B from rotating into the unlocked position.

Figure 4A:
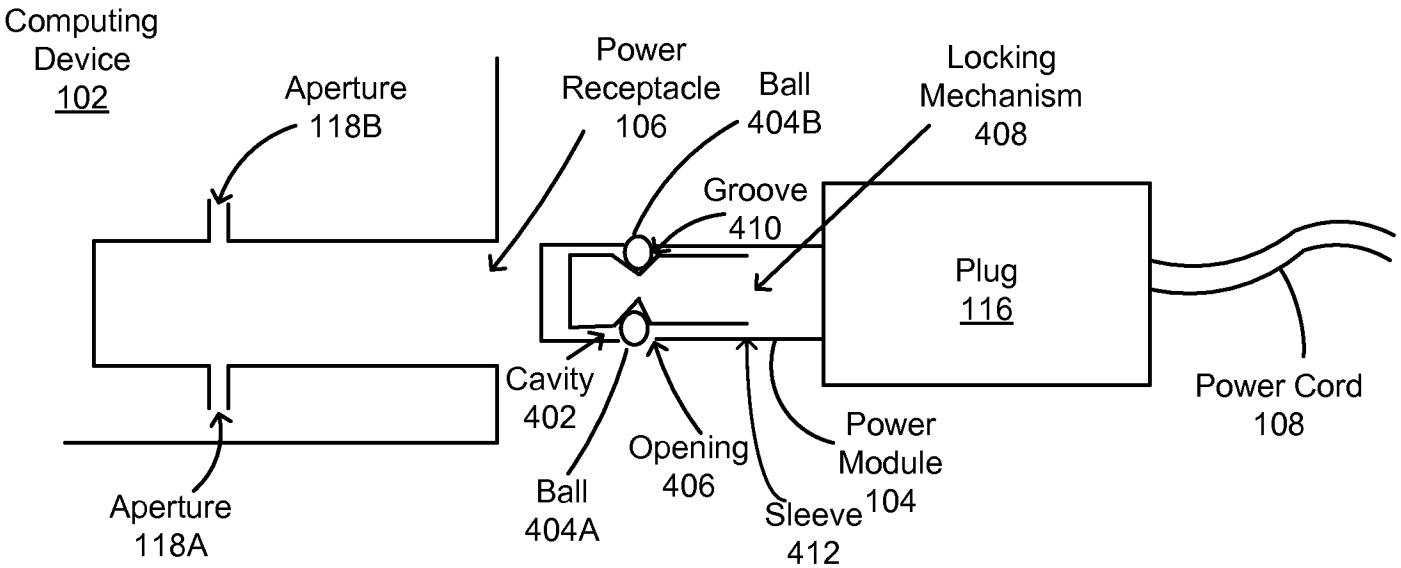
FIG. 4A is a diagram showing the lockable power cord and the power receptacle of the computing device according to another example embodiment in which the lockable power cord is locked into the computing device by balls extending into a groove of the power receptacle.

FIG. 4A is a diagram showing the lockable power cord 100 and the power receptacle 106 of the computing device 102 according to another example embodiment in which the lockable power cord 100 is locked into the computing device 102 by balls 404A, 404B extending into a groove or apertures 118A, 118B of the power receptacle 106. While not shown in FIG. 4A, the lockable power cord 100 and computing device 102 may include the socket 304 and prong 302 shown and described with respect to FIGS. 3A, 3B, 3C, and 3D.

The groove of the power receptacle 106 may include the aperture(s) 118A, 118B, or may include a groove or notch extending around the perimeter of the power receptacle 106. The balls 404A, 404B may extend into the apertures 118A, 118B, and pressure by the balls 404A, 404B against edges of the apertures 118A, 118B may prevent the power module 104 from moving within the power receptacle 106.

In the example shown in FIG. 4A, the power module 104 may include a cavity 402. The cavity 402 may include empty space within the power module 104, and may hold the balls 404A, 404B within the power module 104. The cavity 402 may include empty space between a locking mechanism 408, which may include a bolt, and a sleeve 412 which surrounds the locking mechanism 408. The balls 404A, 404B may be made of any sufficiently rigid material to lock the power module 104 into the power receptacle 106, such as metal or plastic. While two balls 404A, 404B are shown in FIG. 4A, the lockable power cord 100 and/or power module 104 may include any number of balls 404A, 404B.

The cavity 402 may include an opening 406 or groove on the outer surface or sleeve 412 of the power module 104. The sleeve 412 may be secured to the power module 104 by threaded grooves, according to an example embodiment. The opening 406 may have a width which is less than a diameter of the balls 404A, 404B, preventing the balls 404A, 404B from falling through the opening 406. The opening 406 may allow the balls 404A, 404B to protrude or extend out of the cavity 402 of the power module 104 without falling out of the power module 104.

The power module 104 may include a locking mechanism 408. The locking mechanism 408 may include an object, such as a bolt, which may be cylindrical, inside the sleeve 412 of the power module 104. The locking mechanism 408 may include a notch or groove 410. The groove 410 may be configured or sized to allow the balls 404A, 404B to rest in the groove 410 without extending beyond an outer perimeter or sleeve 412 of the power module 104.

When the locking mechanism 408 is in an unlocked state, the groove 410 may align with the opening 406. The alignment of the groove 410 with the opening 406 may allow the balls 404A, 404B to retract into the cavity 402 of the power module 104, allowing the power module 104 to enter and exit the power receptacle 106.

Figure 4B:
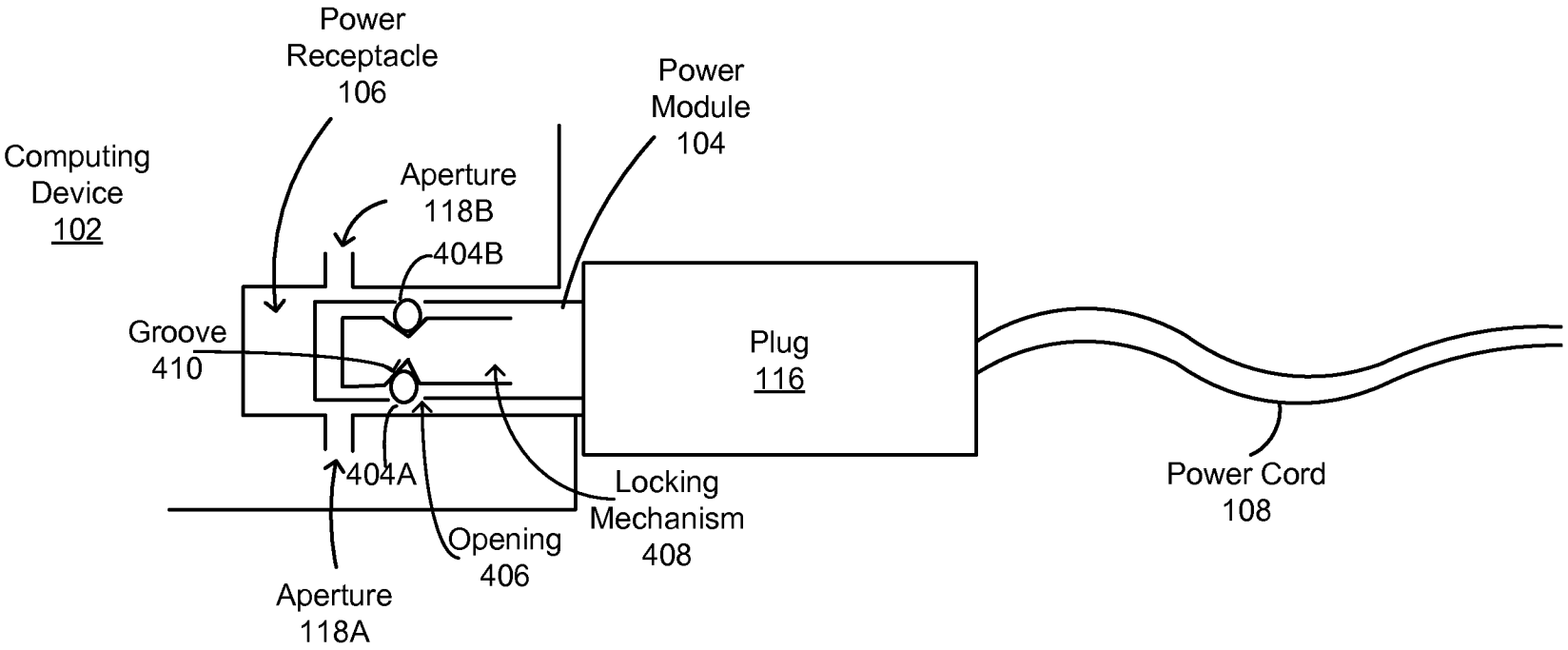
FIG. 4B is another diagram showing the lockable power cord and the power receptacle of the computing device according to the example embodiment shown in FIG. 4A.

FIG. 4B is another diagram showing the lockable power cord 100 and the power receptacle 106 of the computing device 102 according to the example embodiment shown in FIG. 4A. In this example, the locking mechanism 408 is in the unlocked state, the groove 410 is aligned with the opening 406, and the balls 404A, 404B are retracted into the cavity, allowing the power module 104 to enter the power receptacle 106. In this example, the balls 404A, 404B are not aligned with the apertures 118A, 118B or groove of the power receptacle 106; an attempt to lock the power module 104 without first aligning the balls 404A, 404B with the apertures 118A, 118B or groove of the power receptacle 106 could fail because the balls 404A, 404B could press against the walls of the power receptacle 106 without locking in place.

Figure 4C:
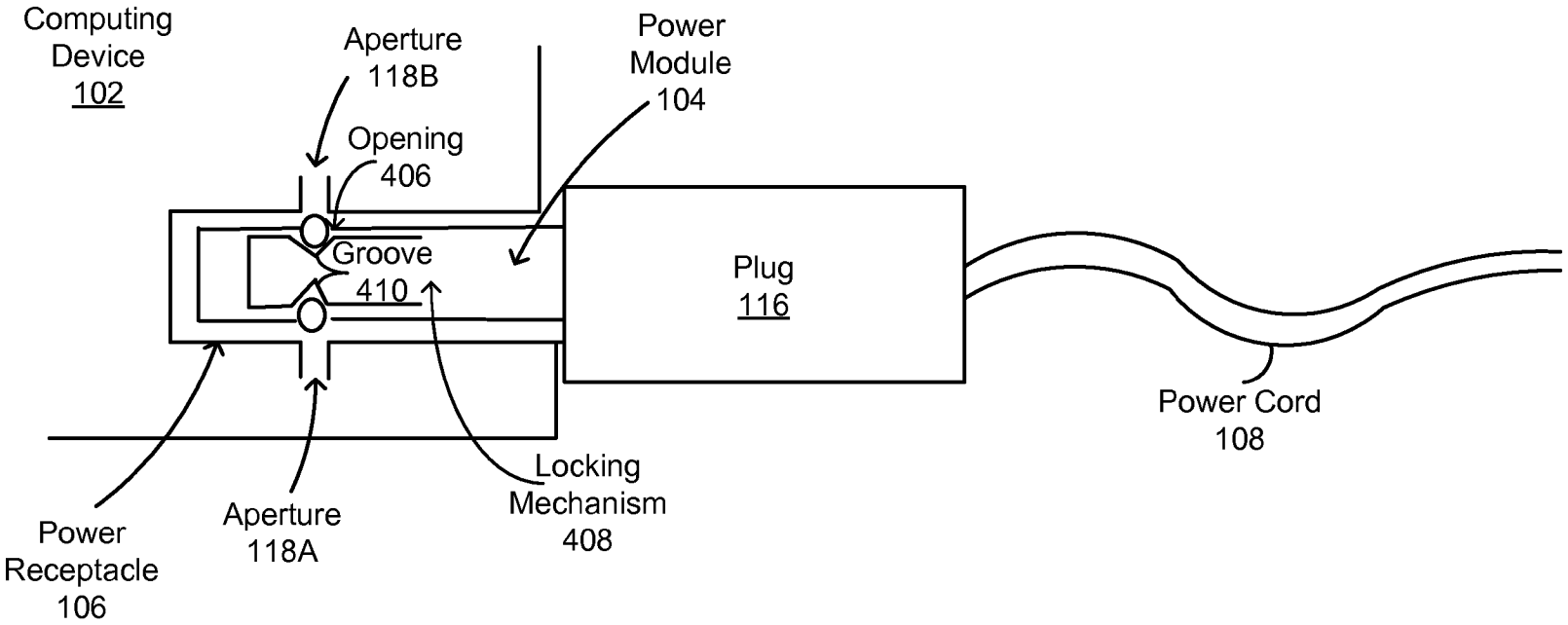
FIG. 4C is another diagram showing the lockable power cord and the power receptacle of the computing device according to the example embodiment shown in FIGS. 4A and 4B.

FIG. 4C is another diagram showing the lockable power cord 100 and the power receptacle 106 of the computing device 102 according to the example embodiment shown in FIGS. 4A and 4B. In this example, as in the example shown in FIG. 4B, the locking mechanism 408 is in the unlocked state, the groove 410 of the power module 104 is aligned with the opening 406 of the power receptacle 106, and the balls 404A, 404B are refracted into the cavity, allowing the power module 104 to move within the power receptacle 106. However, in this example, the balls 404A, 404B are aligned with the apertures 118A, 118B or groove of the power receptacle 106. Transitioning the locking mechanism 408 into the locked state by moving the locking mechanism 408 so that the groove 410 does not align with the opening 406 will force the balls 404A, 404B into the aperture 118A, 118B, locking the power module 104 into the power receptacle, as shown in FIG. 4D.

Figure 4D:
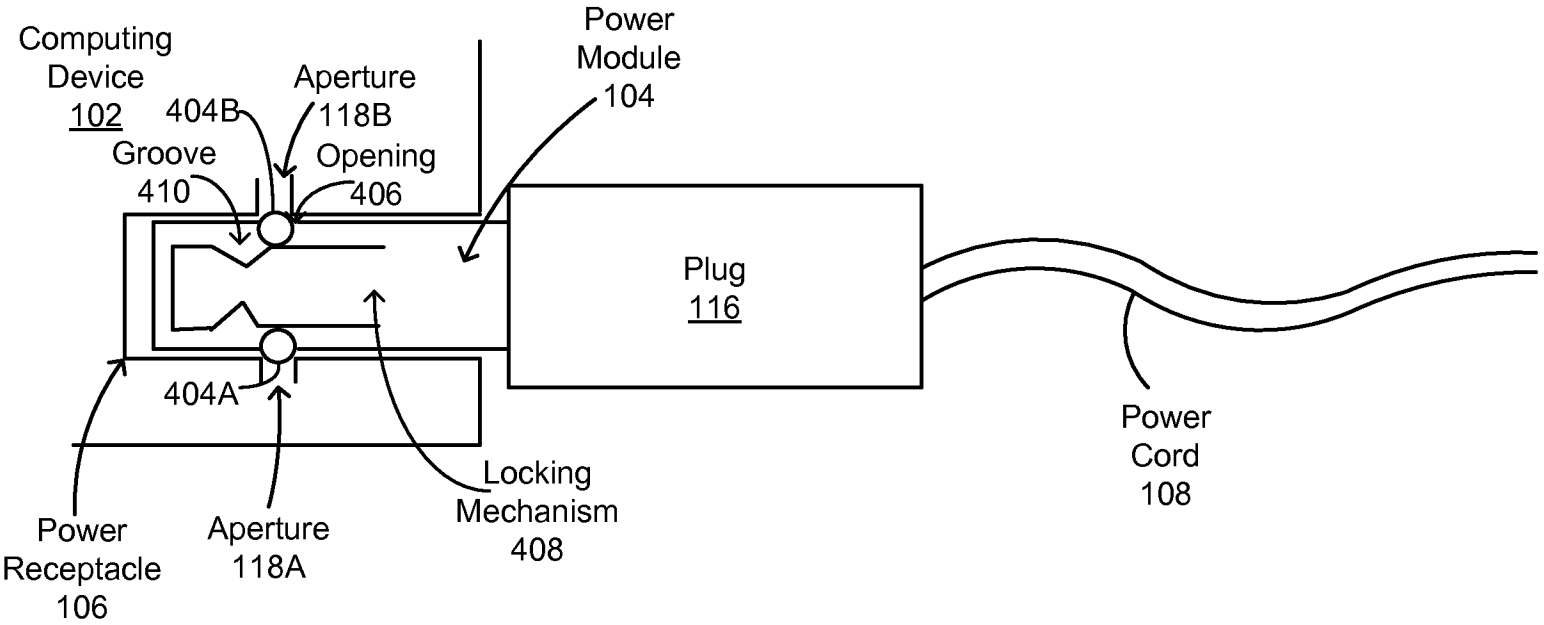
FIG. 4D is another diagram showing the lockable power cord and the power receptacle of the computing device according to the example embodiment shown in FIGS. 4A, 4B, and 4C.

FIG. 4D is another diagram showing the lockable power cord 100 and the power receptacle 106 of the computing device 102 according to the example embodiment shown in FIGS. 4A, 4B, and 4C. In this example, the locking mechanism 408 is in the locked state. The groove 410 is not aligned with the opening 406, and the pressure from the locking mechanism 408 forces the balls 404A, 404B into the apertures 118A, 118B or groove of the power receptacle 106. Pressure from the balls 404A, 404B against sides or edges of the apertures 118A, 118B may prevent the power module 104 from being removed from the power receptacle 106, locking the power cord 100 to the computing device 102. The power module 104 may be removed from the power receptacle 106 only after transitioning the locking mechanism 408 back into the unlocked state by aligning the groove 410 of the power module 104 with the opening 406 of the power receptacle 106, allowing the balls 404A, 404B to retract back into the cavity 404 of the power module 104, according to an example embodiment. Mechanisms for controlling the locking mechanisms described with respect to FIGS. 3A, 3B, 3C, 3D, 4A, 4B, 4C, and 4D will be shown and described with respect to FIGS. 5A, 5B, 5C, and 7.

Figure 5A:
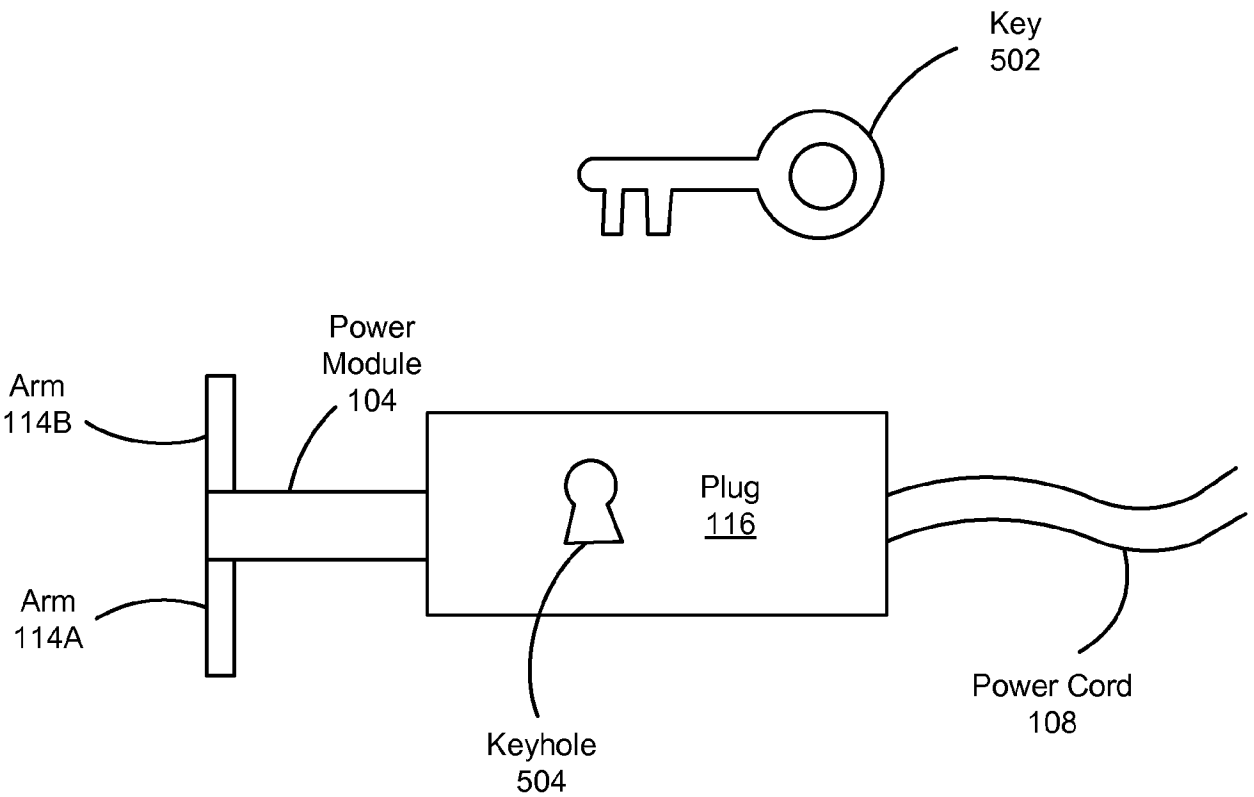
FIG. 5A is a diagram showing the lockable power cord and a key according to an example embodiment in which the lockable power cord is locked and unlocked by the key.

FIG. 5A is a diagram showing the lockable power cord 100 and a key 502 according to an example embodiment in which the lockable power cord 100 is locked and unlocked by a key 502. In this example, the key 502 may match and/or correspond to a keyhole 504. A user may transition any of the locking mechanisms described above with respect to FIGS. 3A, 3B, 3C, 3D, 4A, 4B, 4C, and 4D between the locked and unlocked states by placing the key 502 into the keyhole 504 and rotating the key 502 within the keyhole 504, according to an example embodiment.

Figure 5B:
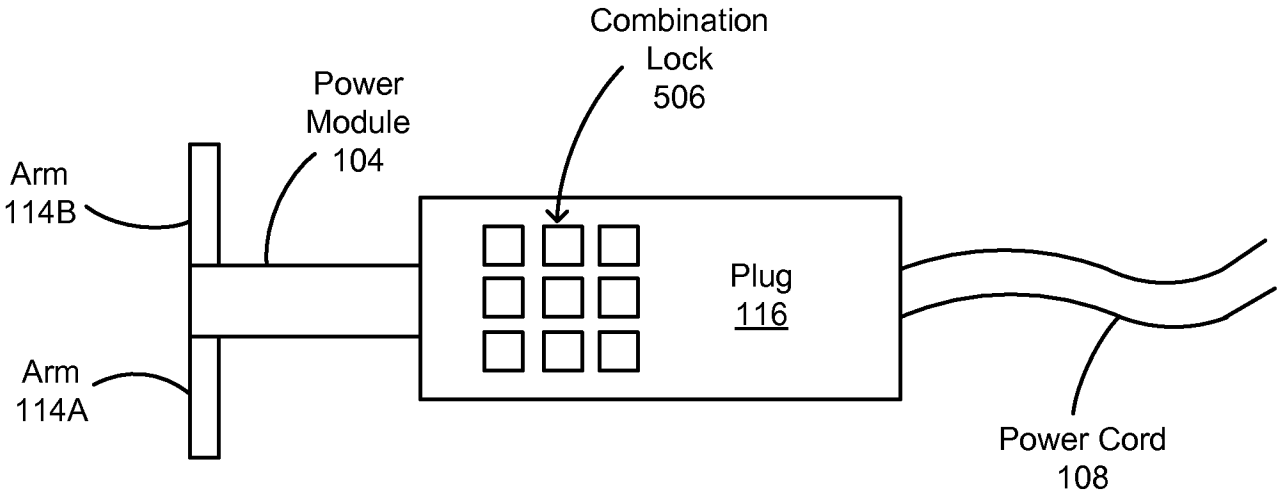
FIG. 5B is a diagram showing the lockable power cord according to another example embodiment in which the lockable power cord is unlocked by a combination lock.

FIG. 5B is a diagram showing the lockable power cord 100 according to another example embodiment in which the lockable power cord 100 is unlocked by a combination lock 506. In this example, the combination lock 506 may include a plurality of buttons. A user may transition any of the locking mechanisms described above with respect to FIGS. 3A, 3B, 3C, 3D, 4A, 4B, 4C, and 4D from the locked state to the unlocked state, and/or vice versa, by entering a predetermined combination into the combination lock 506. In an example embodiment, the predetermined combination may be selected by the user.

Figure 5C:
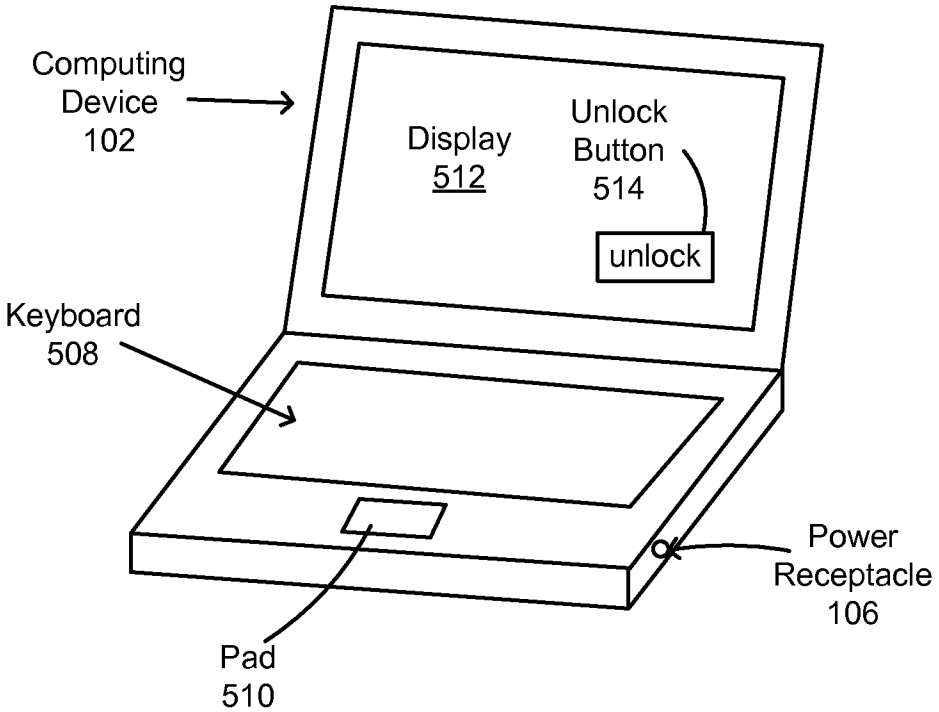
FIG. 5C is a diagram showing the computing device according to an example embodiment in which the lockable power cord may be unlocked by a software feature of the computing device.

FIG. 5C is a diagram showing the computing device 102 according to an example embodiment in which the lockable power cord 100 may be unlocked by a software feature of the computing device. In this example, the computing device 102 may include input devices, such as a keyboard 508 and a mouse or tracking pad 510. The keyboard 508 and pad 510 may provide input from a user to a controller or processor of the computing device 102. The computing device 102 may also include a display 512. The display 512 may provide output to the user. The display 512 may include an unlock button or field 514. The user may unlock the power module 104 (not shown in FIG. 5C) from the power receptacle 106 by providing a predetermined input to the unlock button or field 514, such as clicking the button or providing a predetermined password or combination to the field, according to example embodiments. This software interface may unlock the power module 104 by allowing the arms 114A, 114B to fold back in the example embodiment shown in FIGS. 3A, 3B, 3C, and 3D, by moving the locking mechanism 408 in the example embodiment shown in FIGS. 4A, 4B, 4C, and 4D, or, in the example shown in FIGS. 3A, 3B, 3C, and 3D, by moving a back of the power receptacle 106 back, allowing the power module 104 to be pushed deeper into the power receptacle 106, causing the arms 114A, 114B to fold back before pulling the power module 104 back out of the power receptacle 106.

Figure 5D:
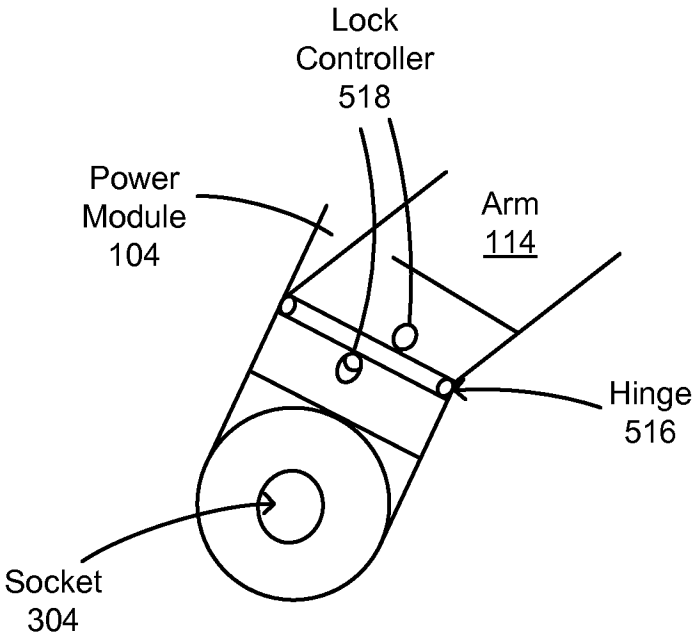
FIG. 5D is a diagram showing the power module of the lockable power cord with a hinge and locking mechanism according to an example embodiment.

FIG. 5D is a diagram showing the power module 104 of the lockable power cord 100 with a hinge 516 and lock controller 518 according to an example embodiment. In this example, the hinge 516 may allow the arms 114A, 114B to move through a range of motion no greater than ninety degrees (90°). The hinge 516 may, for example, allow the arms 114A, 114B to move from the expanded state perpendicular to the power module 104, as shown in FIGS. 3A and 3C, to the folded or inward state shown in FIGS. 3B and 3D.

The power module 104 may also include the lock controller 518. The lock controller 518 may lock the arms 114A, 114B into the expanded state generally perpendicular to the power module 104. When locked, the lock controller 518 may prevent the arms 114A, 114B from folding inwardly toward the power module 104. The lock controller 518 may be controlled by any suitable mechanism, including but not limited to those described above with respect to FIGS. 5A, 5B, and 5C.

Figure 6:
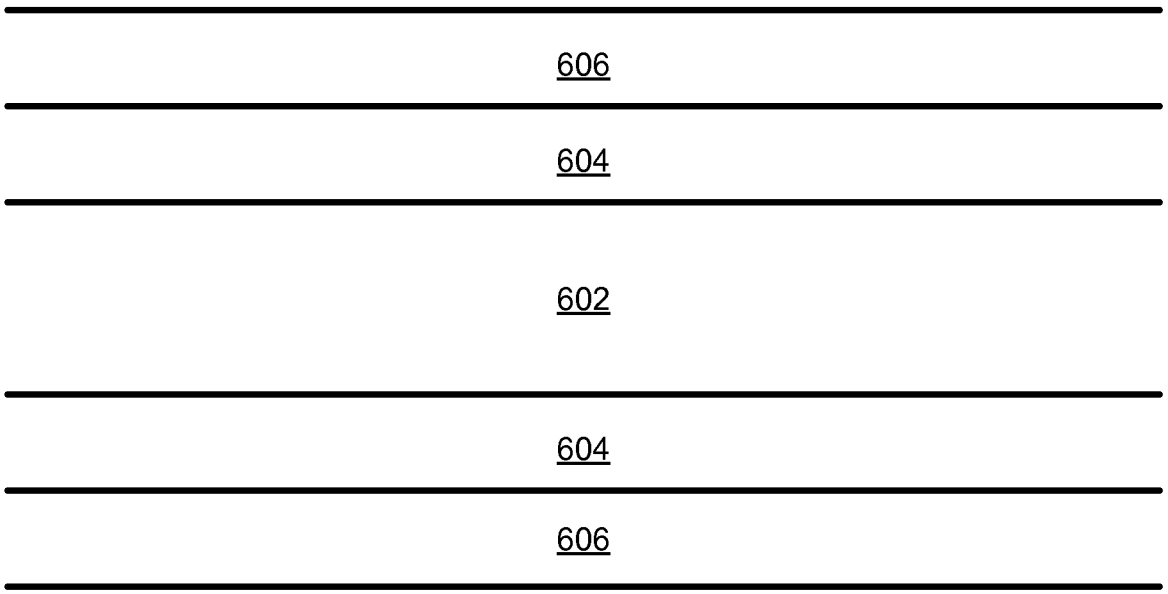
FIG. 6 is a diagram showing a cross-section of a power cord of the lockable power cord according to an example embodiment.

FIG. 6 is a diagram showing a cross-section of a power cord 108 of the lockable power cord 100 according to an example embodiment. In this example, the power cord 108 may include a conductive element or material 602, such as copper, aluminum, silver, gold, or other metal, to conduct electricity or power from the power source to the computing device 102 through the power module 104. The power cord 108 may also include an insulating material 604, such as rubber or plastic. The insulating material 604 may surround the conductive material 602. The power cord 108 may also include an armored housing 606. The armored housing 606 may surround the insulating material 604. The armored housing 606 may, for example, include aluminum, steel, Kevlar, or combinations thereof, either standing alone or woven into a cloth fabric. The armored housing 606 may prevent the power cord 108 from being cut, ripped, or torn.

What is claimed is:

1. A lockable power cord comprising:

a power module configured to enter into a power receptacle of a computing device and to provide power to the computing device;

a locking member including at least one arm member biased radially outward from the power module to an expanded state, the locking member being configured to:

move radially inward toward the power module in response to the power module entering into the power receptacle; and expand radially away from the power module into a locking cavity of the power receptacle when the power module enters beyond a locking point within the power receptacle;

a power cord electrically coupled to the power module;

a power supply integrally coupled to the power cord between the power module and a plug; and a loop mechanically coupled to the power cord, the loop including at least a first opening having a width smaller than a width of the power supply and having a shape configured to:

receive and encircle at least a portion of the power cord between the power module and the power supply; and prevent the power supply from passing through the first opening.

2. The lockable power cord of claim 1, wherein the at least one arm comprises two arms biased radially outward from the power module from opposite sides of the power module.

3. The lockable power cord of claim 1, wherein the at least one arm is configured to extend generally perpendicularly from the power module into the locking cavity when the power module enters beyond the locking point within the power receptacle.

4. The lockable power cord of claim 3, wherein the at least one arm is configured to remain extending generally perpendicularly from the power module and prevent the power module from being removed from the power receptacle when the power module enters beyond the locking point within the power receptacle.

5. The lockable power cord of claim 3, wherein the locking member further comprises a lock controller configured to:

prevent the at least one arm from moving radially inward toward the power module after the power module has entered beyond the locking point within the power receptacle when the lock controller is in a locked state; and allow the at least one arm to move radially inward toward the power module after the power module has entered beyond the locking point within the power receptacle when the lock controller is in an unlocked state.

6. The lockable power cord of claim 3, wherein the locking member further comprises a lock controller configured to:

prevent the at least one arm from moving radially inward toward the power module after the at least one arm has extended generally perpendicularly from the power module into the locking cavity when the lock controller is in a locked state; and allow the at least one arm to move radially inward toward the power module after the at least one arm has extended generally perpendicularly from the power module into the locking cavity when the lock controller is in an unlocked state.

7. The lockable power cord of claim 1, wherein the locking member is symmetrical about a longitudinal axis of the power module.

8. The lockable power cord of claim 1, wherein the power cord comprises:

conductive wires;

an insulated cover surrounding the conductive wires; and an armored housing surrounding the insulated cover.

9. The lockable power cord of claim 1, further comprising:

a hinge coupling the at least one arm to the power module, the hinge being configured to cause the at least one arm to fold toward the power module in response to pressure being applied to the at least one arm in a predetermined direction when a lock controller is in an unlocked state and prevent the at least one arm from folding when the lock controller is in a locked state; and the lock controller configured to transition between the locked state and the unlocked state.

10. The lockable power cord of claim 9, further comprising a combination lock configured to shift the lock controller into the unlocked state when a predetermined combination is entered into the combination lock.

11. The lockable power cord of claim 9, further comprising a keyhole, the lock controller being configured to shift into the unlocked state when a key matching the keyhole is placed into the keyhole and rotated.

12. The lockable power cord of claim 1, wherein the first opening has a width smaller than a width of the power module.

13. The lockable power cord of claim 1, wherein the first opening has a width greater than a width of the power module.

14. The lockable power cord of claim 1, wherein the loop is made of Kevlar.

15. The lockable power cord of claim 1, wherein the loop further includes a second opening having a shape configured to:

receive at least the portion of the power cord between the power module and a power transformer; and prevent the power transformer from passing through the second opening.

16. A lockable power cord comprising:

a power module configured to enter a power receptacle of a computing device and to provide power to the computing device;

a cavity comprising a plurality of balls, the cavity including an opening on an outer surface of the power module which has a width which is less than a diameter of the balls;

a locking mechanism configured to:

force the plurality of balls to extend beyond the outer surface of the power module through the opening and into at least one aperture of the power receptacle, thereby preventing the power module from exiting the power receptacle, from within the cavity when the locking mechanism is in a locked state; and allow the plurality of balls to retract into the cavity of the power module, thereby allowing the power module to exit the power receptacle, when the locking mechanism is in an unlocked state;

a power cord electrically coupled to the power module; and a loop coupled to the power cord, the loop being configured to receive the power cord and thereby secure the lockable power cord to an object around which the power cord extends.

17. The lockable power cord of claim 16, wherein the locking mechanism includes a notched bolt configured to move along a central longitudinal axis of the power module, the locking mechanism being configured to allow the plurality of balls to retract into the cavity by aligning a notch of the notched bolt with the plurality of balls.

18. The lockable power cord of claim 16, wherein the locking mechanism includes a sleeve that:

prevents the plurality of balls from retracting into the cavity by extending alongside the plurality of balls on a side of the plurality of balls which is opposite from the outer surface of the power module when the locking mechanism is in the locked state; and allows the plurality of balls to retract into the cavity by pulling away from the plurality of balls when the locking mechanism is in the locked state.

19. The lockable power cord of claim 18, wherein the sleeve is secured to the power module by threaded grooves.

20. The lockable power cord of claim 16, further comprising a keyhole, the locking mechanism being configured to toggle between the locked state and an unlocked state in response to rotation of a matching key within the keyhole.

* * * * *